US007039972B2

(12) United States Patent
Chaffee

(10) Patent No.: US 7,039,972 B2
(45) Date of Patent: May 9, 2006

(54) INFLATABLE DEVICE WITH RECESSED FLUID CONTROLLER AND MODIFIED ADJUSTMENT DEVICE

(76) Inventor: Robert B. Chaffee, 78 Montgomery St., Boston, MA (US) 02116

( * ) Notice: Subject to any disclaimer, the term of this patent is extended or adjusted under 35 U.S.C. 154(b) by 51 days.

(21) Appl. No.: 09/859,706

(22) Filed: May 17, 2001

(65) Prior Publication Data

US 2001/0044969 A1 Nov. 29, 2001

Related U.S. Application Data

(60) Provisional application No. 60/280,040, filed on Mar. 30, 2001, provisional application No. 60/204,836, filed on May 17, 2000.

(51) Int. Cl.
*A47C 27/08* (2006.01)

(52) U.S. Cl. ..... 5/706; 5/655.3

(58) Field of Classification Search ..... 5/710, 5/713, 655.3, 711, 708, 706; 297/284.6; 137/565.16, 565.18
See application file for complete search history.

(56) References Cited

U.S. PATENT DOCUMENTS

| | | | | |
|---|---|---|---|---|
| 1,451,136 | A | | 4/1923 | Allnut |
| 3,026,909 | A | | 3/1962 | Boteler |
| 3,068,494 | A | | 12/1962 | Pinkwater |
| 3,099,386 | A | | 7/1963 | Pieper |
| 3,112,502 | A | * | 12/1963 | Forsberg ..... 5/708 |
| 3,142,850 | A | | 8/1964 | De Boer |
| 3,505,695 | A | | 4/1970 | Bishaf et al. |
| 3,563,676 | A | | 2/1971 | Coovert et al. |
| 3,995,653 | A | * | 12/1976 | Mackal et al. ..... 137/234 |
| 4,080,105 | A | | 3/1978 | Connell |
| 4,146,069 | A | | 3/1979 | Angarola et al. |
| 4,146,070 | A | | 3/1979 | Angarola et al. |
| 4,213,745 | A | | 7/1980 | Roberts |
| 4,225,989 | A | | 10/1980 | Corbett et al. |

(Continued)

FOREIGN PATENT DOCUMENTS

DE 44 13 445 A1 10/1995

(Continued)

OTHER PUBLICATIONS

Imaginair by aero, Instruction Manual, Dec. 1999, Imaginair Incorporated, Wauconda, IL, USA.

(Continued)

*Primary Examiner*—Michael Safavi
*Assistant Examiner*—Gay Ann Spahn
(74) *Attorney, Agent, or Firm*—Lowrie, Lando & Anastasi, LLP

(57) ABSTRACT

The application is related to inflatable devices, and, more specifically, to an inflatable device with a recessed fluid controller and improved adjustment device. In one embodiment, the application is directed to an inflatable device comprising a substantially fluid impermeable bladder and a fluid controller comprising an electrically powered pump at least partly positioned within the bladder. In another embodiment, the application is directed to a combination of a fluid controller comprising an electrically powered pump and an inflatable device. The combination comprises the fluid controller connected to the inflatable device such that the exterior profile of the fluid controller and inflated inflatable device in combination is essentially the same as the exterior profile of the inflated inflatable device. In another embodiment, the application is directed to an inflatable system comprising a substantially fluid impermeable bladder and a fluid controller comprising pump in fluid communication with the bladder. The fluid controller further comprises a first locking mechanism and a adjustment device including a second locking mechanism sized and adapted to reversibly mate with the first locking mechanism.

40 Claims, 6 Drawing Sheets

U.S. PATENT DOCUMENTS 4,521,166 A 6/1985 Phillips
4,678,014 A 7/1987 Owen et al.
4,678,410 A 7/1987 Kullen
4,692,091 A 9/1987 Ritenour
4,711,275 A * 12/1987 Ford et al. ..... 141/95
4,734,017 A 3/1988 Levin
4,829,616 A 5/1989 Walker
4,862,533 A 9/1989 Adams, III
4,890,344 A 1/1990 Walker
4,897,890 A 2/1990 Walker
4,977,633 A 12/1990 Chaffee
4,986,738 A * 1/1991 Kawasaki et al. ..... 417/304
4,990,060 A * 2/1991 Cheng-Chung ..... 417/84
5,051,060 A 9/1991 Fleischmann et al.
5,068,933 A 12/1991 Sexton
5,144,708 A 9/1992 Pekar
5,170,522 A * 12/1992 Walker ..... 5/615
5,203,808 A * 4/1993 Ide ..... 5/672
5,249,319 A 10/1993 Higgs
5,267,363 A 12/1993 Chaffee
5,406,661 A 4/1995 Pekar
5,494,418 A 2/1996 Moriya et al.
5,598,593 A * 2/1997 Wolfe ..... 5/710
5,727,270 A 3/1998 Cope et al.
5,746,873 A * 5/1998 Graf ..... 156/274.4
5,857,841 A 1/1999 Kobayashi et al.
5,890,882 A * 4/1999 Feldman ..... 417/411
5,893,609 A * 4/1999 Schmidt ..... 297/284.6
5,903,941 A * 5/1999 Shafer et al. ..... 318/601
5,904,172 A * 5/1999 Gifft et al. ..... 137/224
6,099,248 A 8/2000 Mumm et al.
6,108,844 A 8/2000 Kraft et al.
6,129,524 A 10/2000 Woollenweber et al.
6,206,654 B1 3/2001 Cassidy
6,237,653 B1 5/2001 Chaffee
D446,284 S 8/2001 Chaffee
6,287,095 B1 * 9/2001 Saputo et al. ..... 417/472
6,296,459 B1 10/2001 Saputo et al.
6,332,760 B1 * 12/2001 Chung ..... 417/239
6,483,264 B1 11/2002 Shafer et al.
6,530,751 B1 3/2003 Song et al.
6,543,073 B1 * 4/2003 Wu ..... 5/713
6,565,315 B1 5/2003 Bertels et al.
6,571,412 B1 * 6/2003 Wu ..... 5/658
6,659,737 B1 12/2003 Bader et al.
6,679,686 B1 * 1/2004 Wang ..... 417/423.1
6,709,246 B1 * 3/2004 Boyd ..... 417/423.1
6,722,306 B1 * 4/2004 Wang ..... 114/345
6,733,254 B1 * 5/2004 Yen ..... 417/423.1
6,793,469 B1 * 9/2004 Chung ..... 417/411
6,836,914 B1 * 1/2005 Tsai ..... 5/713
2001/0026763 A1 * 10/2001 Chung ..... 417/360
2002/0194678 A1 * 12/2002 Chung ..... 5/713
2003/0003001 A1 1/2003 Chaffee
2003/0024050 A1 2/2003 Boso et al.
2003/0099560 A1 * 5/2003 Wang ..... 417/423.1
2003/0215340 A1 * 11/2003 Chung ..... 417/229
2004/0037717 A1 * 2/2004 Wang ..... 417/411
2004/0241014 A1 * 12/2004 Yen ..... 417/360
2005/0047923 A1 * 3/2005 Li et al. ..... 417/44.9
2005/0118046 A1 * 6/2005 Wang ..... 417/423.15
2005/0186097 A1 * 8/2005 Wang ..... 417/423.3

FOREIGN PATENT DOCUMENTS

DE 297 21 150 U1 2/1998
DE 29721150 U1 2/1998
JP 05137809 A * 6/1993
WO WO 93/05684 1/1993
WO WO 03/093709 A1 5/2003

OTHER PUBLICATIONS

Imaginair Aero Product Catalog, 2000 Imaginair Incorporated, Wauconda, Il, USA.
Supreme Fast-Fill, 2000 Intex Recreation Corpl, Long Beach, CA, USA.
U. S. Appl. No. 10/113,836, filed Apr. 1, 2002.

* cited by examiner

INFLATABLE DEVICE WITH RECESSED FLUID CONTROLLER AND MODIFIED ADJUSTMENT DEVICE

This application claims priority to U.S. Provisional Patent Application Ser. No. 60/204,836, filed May 17, 2000 and to U.S. Provisional Patent Application Ser. No. 60/280,040, filed Mar. 30, 2001.

BACKGROUND

1. Field of the Application

The application is related to inflatable devices, and, more specifically, to an inflatable device with a recessed fluid controller and modified adjustment device.

2. Description of the Related Art

Inflatable devices are used in a variety of contexts, such as where buoyancy or a cushioned support is needed, where space is limited or portability is desired. For example, inflatable mattresses, cushions and other body supports are used for applications such as camping, hospital bedding, and both occasional and everyday bedding in the home. Such inflatable devices have the additional advantage that the degree of inflation of the support can be adjusted to provide selective support of an irregular object, such as a person. Other examples of inflatable devices include boats, rafts and other devices for use in the water.

A variety of methods are known for providing a fluid, such as air, to inflate an inflatable device. Typically, a pump is used to supply fluid to an orifice in the inflatable device. In most instances, fluid is introduced into inflatable devices through an inlet that may be sealed to retain fluid within the inflatable device. The inlet may also serve as an outlet for deflating the inflatable device. A pump for use with an inflatable device may include a motor that drives an impeller, moving the fluid into, or out of, the inflatable device. Motorized pumps may be powered by electricity. Typically, such electricity is provided by a connection to standard house current or, where portability is desired, batteries.

One known inflatable device is illustrated in FIG. 1. This inflatable device is adapted for use as a mattress and includes a bladder 20 constructed to contain air in the shape of a mattress. The inflatable device also includes a fluid controller 80 connected to bladder 20 comprising a pump adapted to inflate bladder 20 when connected to household electric current. One such pump is described in U.S. Pat. No. 5,267,363, herein incorporated by reference.

SUMMARY

In one embodiment, the application is directed to an inflatable device comprising a substantially fluid impermeable bladder and a fluid controller comprising an electrically powered pump at least partly positioned within the bladder.

In another embodiment, the application is directed to a combination of a fluid controller comprising an electrically powered pump and an inflatable device. The combination comprises the fluid controller connected to the inflatable device such that the exterior profile of the fluid controller and inflated inflatable device in combination is essentially the same as the exterior profile of the inflated inflatable device.

In another embodiment, the application is directed to an inflatable system comprising a substantially fluid impermeable bladder and a fluid controller comprising a pump in fluid communication with the bladder. The fluid controller further comprises a first locking mechanism and an adjustment device including a second locking mechanism sized and adapted to reversibly mate with the first locking mechanism.

In another embodiment, the application is directed to an inflatable device, comprising a substantially fluid impermeable bladder and a fluid controller. The fluid controller comprises an electrically powered pump, a self-sealing valve, and an adjustment device. The adjustment device comprises a first switch electrically connected to the pump and a power source such that the first switch may selectively energize the pump, and a second switch electrically connected to a power source and electro-mechanically connected to a valve of the fluid controller such that it may selectively open the valve.

The term "recess" is defined herein as an indentation. For example, a recess in a bladder may comprise an indentation in a wall of the bladder, in which an object (e.g., a fluid controller) may be located.

The term "profile of a bladder" is defined herein as an outermost outline of the bladder, exclusive of any irregularities. For example, the profile of the bladder 20 is illustrated in FIG. 2 by solid line 14. The profile excludes any recess in bladder 20 in which fluid controller 80 may be disposed.

BRIEF DESCRIPTION OF DRAWINGS

The foregoing and other advantages of the application will be more fully appreciated with reference to the following drawings in which.

DETAILED DESCRIPTION

The application is directed to an inflatable device with a recessed fluid controller and modified adjustment device. As used herein, a fluid controller is a device capable of regulating fluid flow and may include various components, such as a housing, valve, fluid conduit, pump, and the like. In one embodiment, the application is directed to an inflatable device including a substantially fluid impermeable bladder and a fluid controller comprising an electrically powered pump at least partly positioned within the bladder. As used herein, an object, such as a fluid controller, that is "positioned within" a bladder occupies a portion of the volume that would normally be occupied by the bladder, but need not be within the wall of the bladder. For example, a fluid controller could be located within a recess in the wall of a bladder and be "positioned within" the bladder, as this term is defined and used herein.

Figure 1:
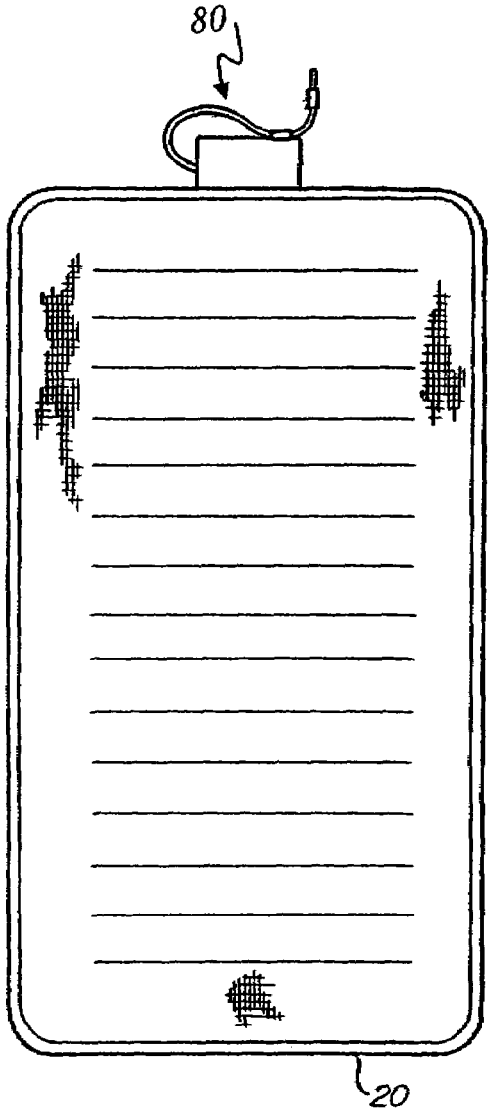
Fig. 1 (PRIOR ART)
FIG. 1 is a top, plan view of a prior art inflatable device.
Figure 2:
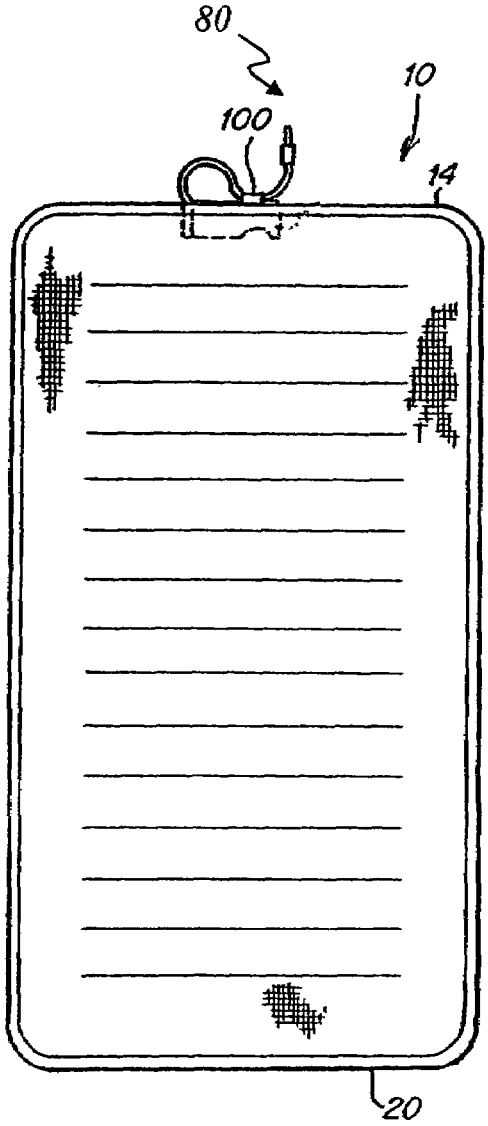
FIG. 2 is a top, plan view of an inflatable device according to one embodiment of the application.

Referring now to the figures, and, in particular FIG. 2, one embodiment of an inflatable device according to the application will be described by way of example. The embodiment illustrated in FIG. 2 includes an inflatable device 10 having a substantially fluid impermeable bladder 20 and a fluid controller 80 comprising an electrically powered pump at least partly positioned within bladder 20.

Bladder 20 may be constructed in any manner and of any material(s) capable of retaining a desired fluid under a degree of pressure necessary for its intended application. For example, bladder 20 may be constructed of a substantially fluid impermeable barrier and may be shaped in accordance with its intended use. Where bladder 20 is intended for use as a mattress, bladder 20 may be constructed in the shape and thickness of a conventional mattress.

Bladder 20 may include internal structure, such as ribs or partitions. For example, bladder 20 may be divided into two or more separate fluid containing compartments. Bladder 20 may also include internal structure to control the movement of fluid within bladder 20. For example, bladder 20 may include baffles or walls within bladder 20 to improve the flow of fluid when bladder 20 is inflated or deflated.

A wall of bladder 20 may be any thickness required to substantially contain a fluid under pressures at which bladder 20 will be used. A thickness of the wall of bladder 20 may depend upon material from which bladder 20 is constructed. For example, more durable or elastic materials may not require the wall of bladder 20 to be as thick as less durable or elastic materials. Typically, the wall of bladder 20 may be 4–16 mils thick for polyvinyl chloride (PVC) film and polyurethane materials.

Bladder 20 may be constructed of any material or materials capable of substantially containing a fluid and forming a bladder 20 strong enough to withstand a pressure at which bladder 20 is to be used. For example, bladder 20 may be constructed of a polymeric material, such as a thermoplastic. Bladder 20 may be constructed from a relatively inexpensive, easy to work with and durable material. Some example materials include polyvinyl chloride (PVC) film and polyester. The manner of making bladder 20 may depend on its material of construction and configuration, as will be recognized by one of ordinary skill in the art.

Bladder 20 may include additional materials to improve the utility and comfort of bladder 20. For example, bladder 20 may include outer layers or coatings for durability, support or comfort. In some embodiments, bladder 20 may be coated with a material that is more pleasant to the touch than the material from which bladder 20 is constructed. Where inflatable device 10 is for use in supporting a person, bladder 20 may also include a layer to provide additional comfort, particularly where the person is to contact bladder 20. For example, bladder 20 may include a comfort layer. The comfort layer may be located on any surface of bladder 20 that may come into contact with a user of inflatable device 10. The comfort layer may improve the texture and feel of bladder 20 and, further, may allow air and moisture to pass between a person and bladder 20, preventing discomfort.

Figure 5:
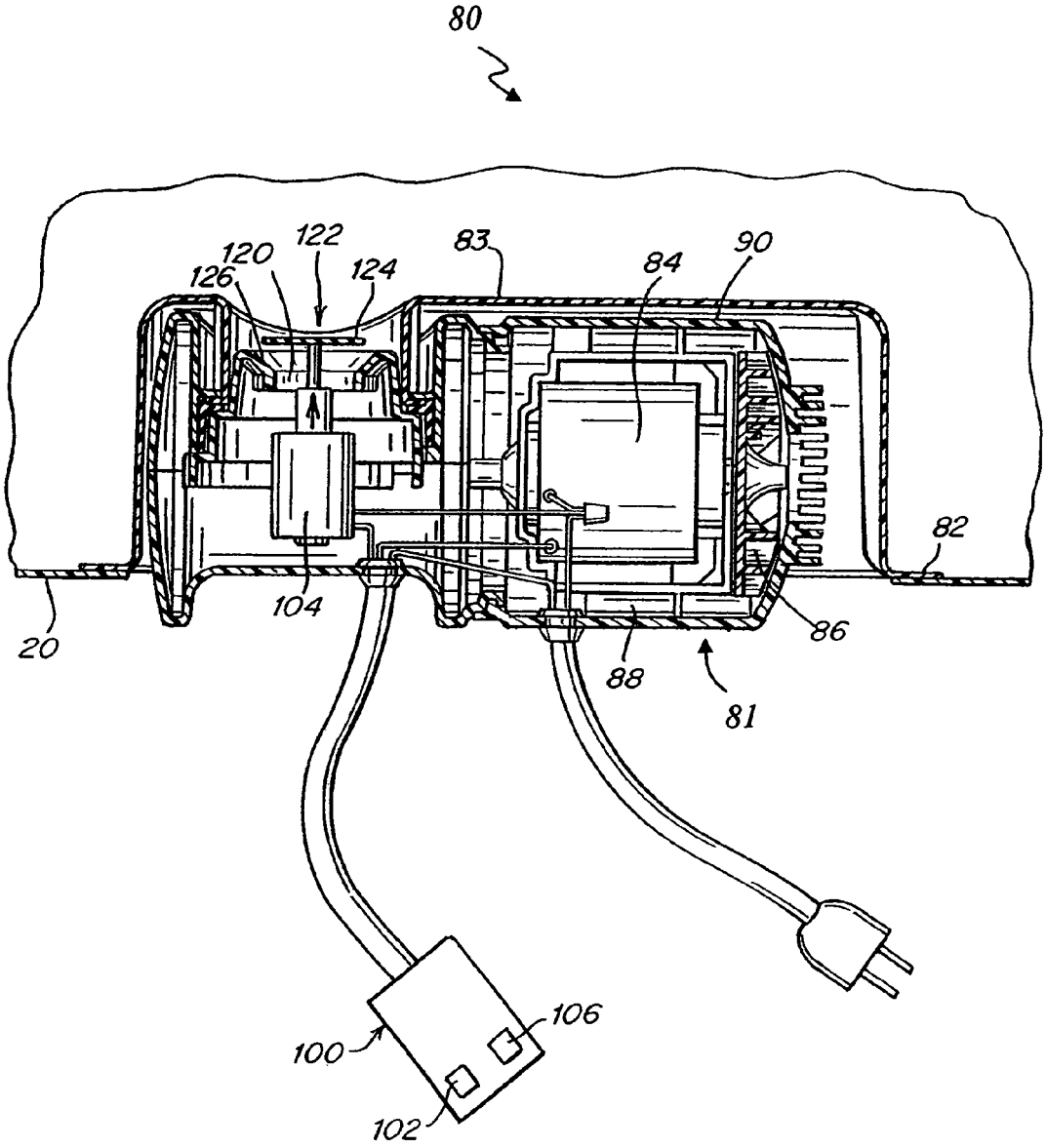
FIG. 5 is a top, cross-sectional view of one embodiment of the application.
Figure 6:
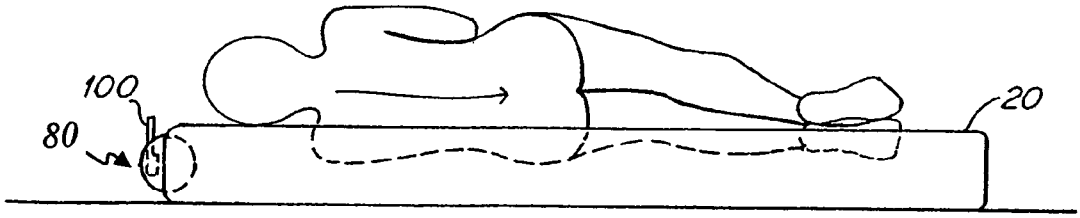
FIG. 6 is a side, cross-sectional view of another embodiment of the application.

Fluid controller 80 may be constructed in any manner and using any materials that allow fluid controller 80 to control the flow of fluid into and/or out of bladder 20. In one embodiment, fluid controller 80 includes a pump 81 that may be constructed in any manner and using any materials that allow it to inflate and/or deflate bladder 20. For example, as illustrated in FIG. 5, the pump 81 may be a conventional fluid pump including a motor 84 that drives an impeller 86 moving air into, or out of, bladder 20. Where the pump includes motor 84, motor 84 may be powered by electricity. Electricity may be provided by a connection to standard house current or, where portability is desired, by batteries. Other types of pumps, such as diaphragm pumps, may also be used so long as they allow the pump to inflate bladder 20 to within a desired pressure range, which may include a pressure range that can be adjusted by, for example, another fluid pumping device, such as someone blowing into a conventional valve stem within the bladder, a foot pump, and the like.

Fluid controller 80 may direct fluid flow in any manner consistent with its construction. For example, where fluid controller 80 includes a pump 81 with motor 84 and impeller 86, impeller 86 may draw fluid into, or out of, bladder 20 through a conduit 88. In some embodiments, conduit 88 may be positioned between motor 84 and a housing 90, as an annulus. For example, in the embodiment illustrated in FIG. 5, fluid controller 80 includes a housing 90 that surrounds the inner workings of the pump. Housing 90 may also serve, for example, to protect the inner workings of the pump and to provide a connection between fluid controller 80 and bladder 20.

Preferably, where a pump is included in fluid controller 80, the pump is able to inflate bladder 20 in a relatively short time period, such as in less than a minute for an inflatable mattress. The pump may be designed to include an appropriately powerful fluid moving mechanism to achieve a desired pumping time to fill a particular inflatable device. The pump also may be small and consume as little power as possible. Low power consumption is particularly desirable where the pump is to be powered by batteries, as it may extend battery life. The pump may also be configured to be quiet in operation. A balance of pumping capacity, size, power consumption, noise generation and cost may be selected for a particular application as will be recognized by those of skill in the art.

Fluid controller 80 may be constructed of any material or materials that allow it to function as desired. Typical materials of construction of the various components of fluid controller 80 will vary with the nature of fluid controller 80 and any pump and are known to those of skill in the art.

Figure 8:
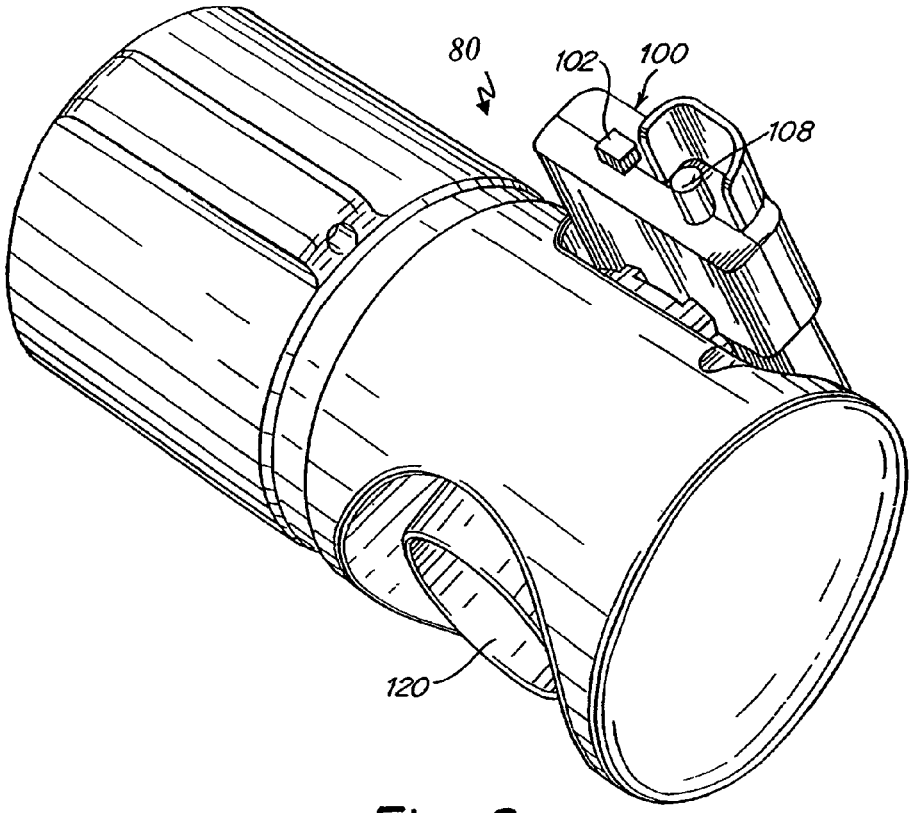
FIG. 8 is a perspective, plan view of another embodiment of the application.
Figure 9:
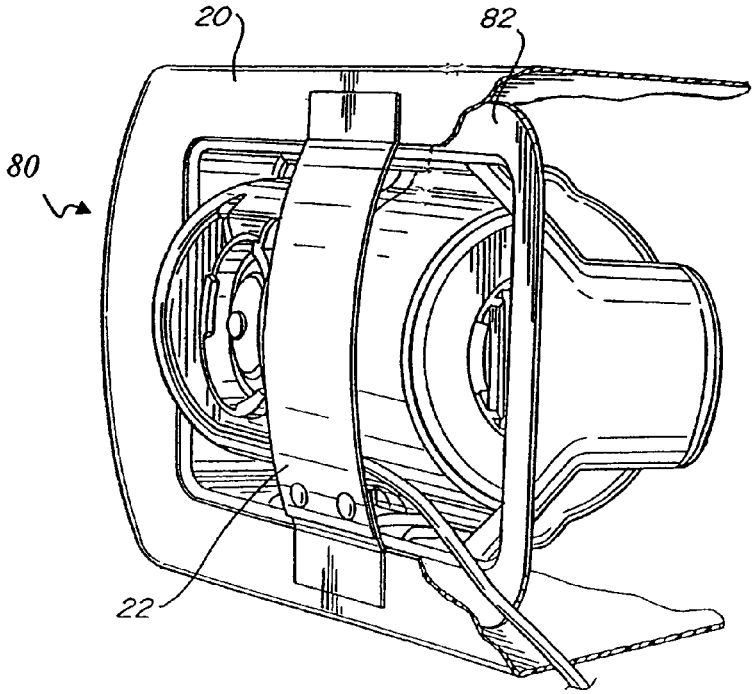
FIG. 9 is a perspective, plan view of another embodiment of the application.

Fluid controller 80 may be connected to bladder 20 in any manner that allows a pump to supply bladder 20 with fluid, inhibits undesired escape of fluid from bladder 20 and does not interfere with the use of bladder 20. For example, inflatable device 10 may be constructed with at least a portion of fluid controller 80 positioned within bladder 20. Where fluid controller 80 is positioned at least partially within bladder 20, fluid controller 80 will not interfere with the use of inflatable device 10. In one embodiment, the exterior profile (total volume and shape) of the fluid controller and inflated device in combination are essentially the same as the exterior profile of the inflated device absent the combination, thus reducing the opportunity for fluid controller 80 to impact or interfere with the use of inflatable device 10. For example, where fluid controller 80 is located substantially within bladder 20 in a mattress application, it allows an inflatable standard sized mattress to fit into a standard sized bed frame. Where fluid controller 80 is located within bladder 20, it may be sized such that it will not come into contact with bladder 20 when bladder 20 is inflated, except at the point(s) of connection.

Where at least a portion of fluid controller 80 is positioned within bladder 20, it may be connected to bladder 20 in any manner that will not interfere with the use of inflatable device 10 or allow undesired escape of fluid from bladder 20. For example, bladder 20 may be adhered or sealed to a portion of fluid controller 80, such as with an adhesive or heat seal. In one embodiment, an outlet 120 (illustrated in FIG. 8) of fluid controller 80 is sealed to bladder 20.

Figure 3:
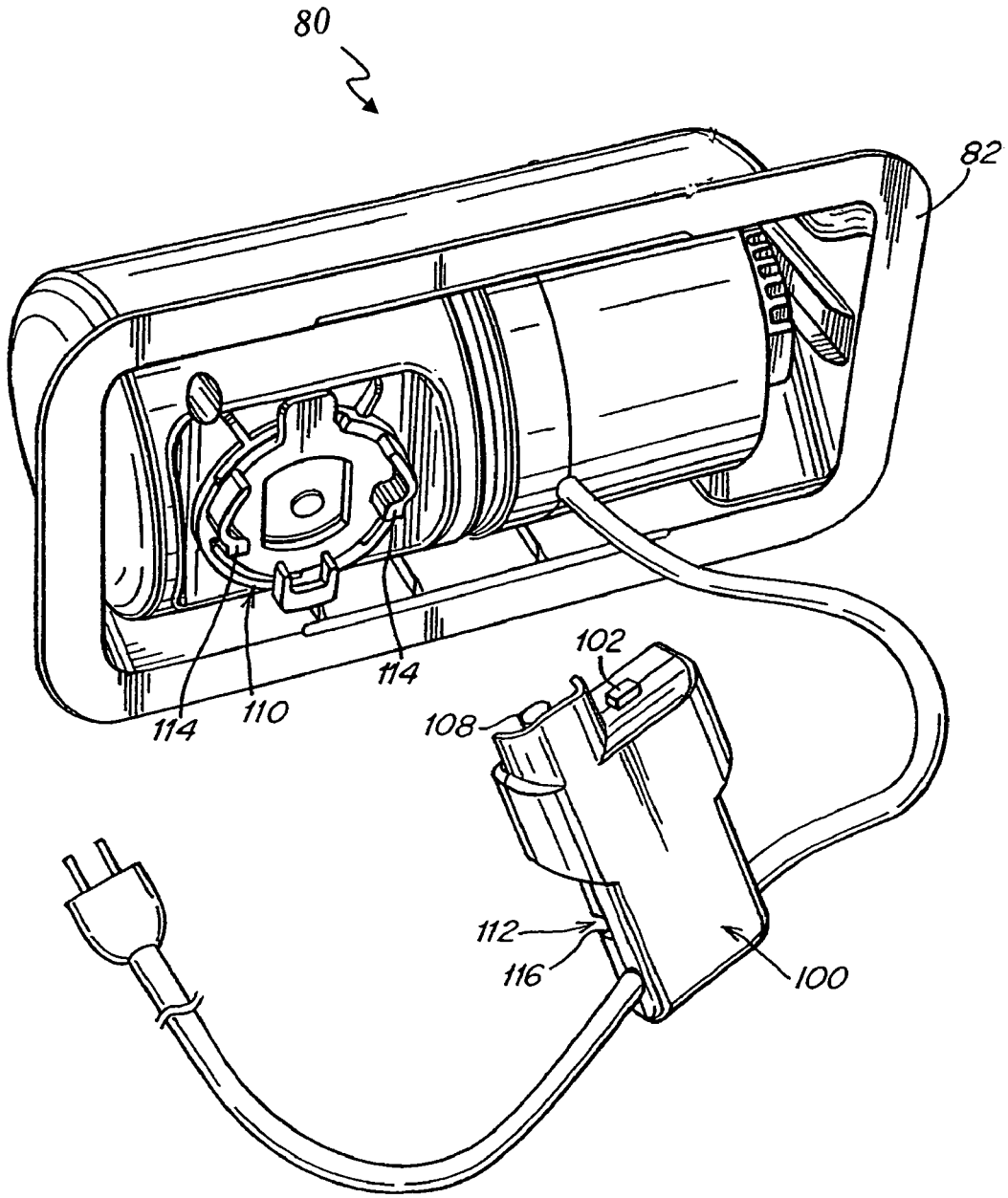
FIG. 3 is a perspective, plan view of a fluid controller according to one embodiment of the application.
Figure 4:
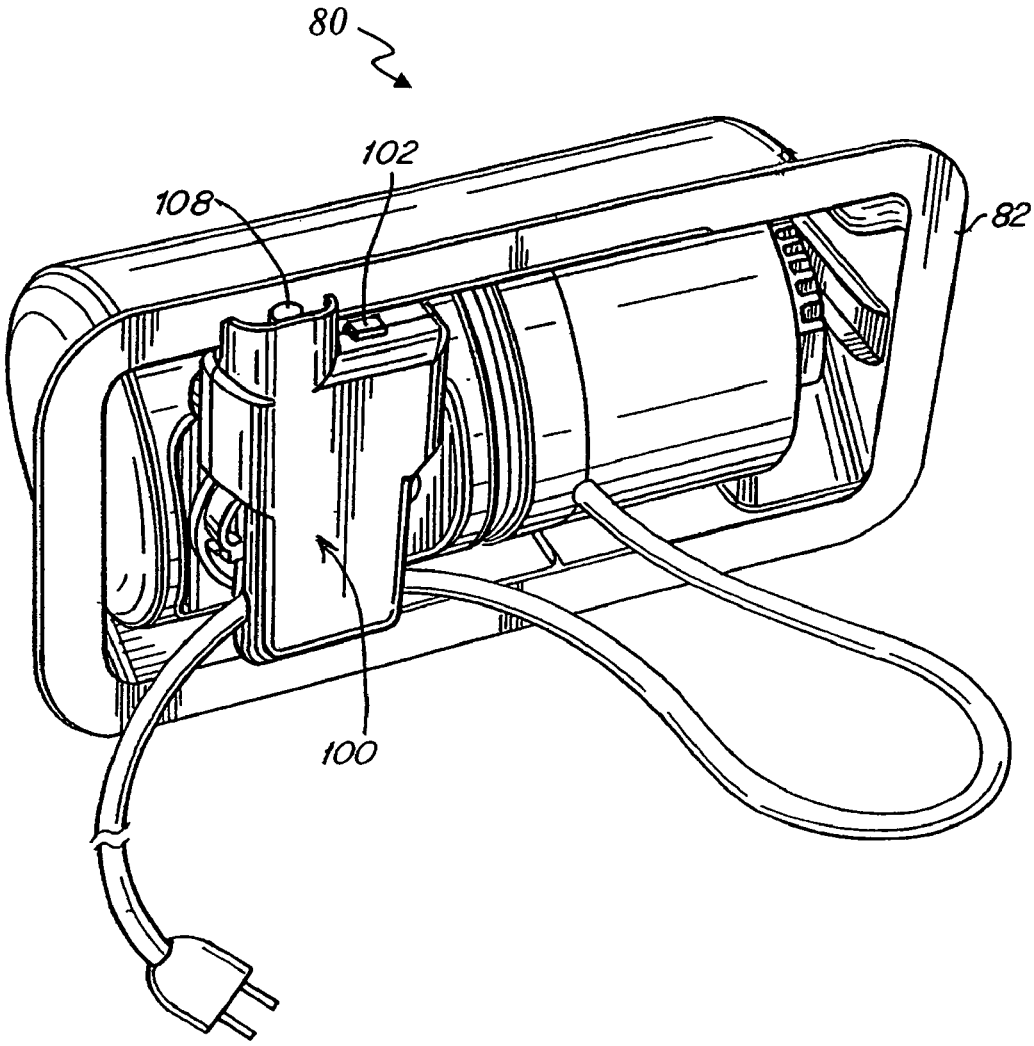
FIG. 4 is a perspective, plan view of a fluid controller according to another embodiment of the application.

Fluid controller 80 may include structure to facilitate connection to bladder 20. for example, fluid controller 80 may include a portion adapted to connect to bladder 20, such as a flange 82 as illustrated in FIGS. 3–5. Flange 82 may, for example, extend from housing 90 or may be a separate component connected to housing 90. As best seen in FIG. 5, flange 82 may include additional structure, such as a fluid impermeable wall 83, that may allow it to perform other functions in fluid controller 80 in addition to providing a connection point for bladder 20. Where flange 82 is connected to housing 90, it may be connected anywhere and in any manner that allows it to fluid tightly connect fluid controller 80 and bladder 20. For example, where flange 82 includes a fluid impermeable wall 83, flange 82 may be connected to housing 90 at or near outlet 120 from housing 90.

Flange 82 may be constructed of any material that allows it to durably and fluid tightly connect fluid controller 80 to bladder 20. For example, flange 82 may be constructed of a material that is more flexible than housing 90, but less flexible than bladder 20, bridging the flexibility gap between the two structures and resulting in a durable seal that may be performed, for example, by heat sealing. One example of a suitable material of construction of flange 82 is PVC. The thickness of flange 82 may also affect its flexibility, with thinner flanges generally being more flexible than thicker flanges. Thus the thickness of flange 82 may be selected to provide a desired flexibility with a given material.

Where flange 82 connects to housing 90 or another portion of fluid controller 80, it is preferred that such connection be reversible. For example flange 82 may snap or screw together with another portion of fluid controller 80. Additional structure may be included to promote a fluid seal between flange 82 and the remainder of fluid controller 80. For example, a seal, such as an o-ring, may be placed between flange 82 and the remainder of fluid controller 80. It is also possible to construct the inflatable device such that bladder 20 and fluid controller 80 are reversibly connected, rather than two portions of fluid controller 80 being reversibly connected. In either case, the reversible connection allows the removal of portions of fluid controller 80 for repair or replacement, preventing the entire inflatable device from having to be disposed of in the event of a failure of one component.

Figure 7:
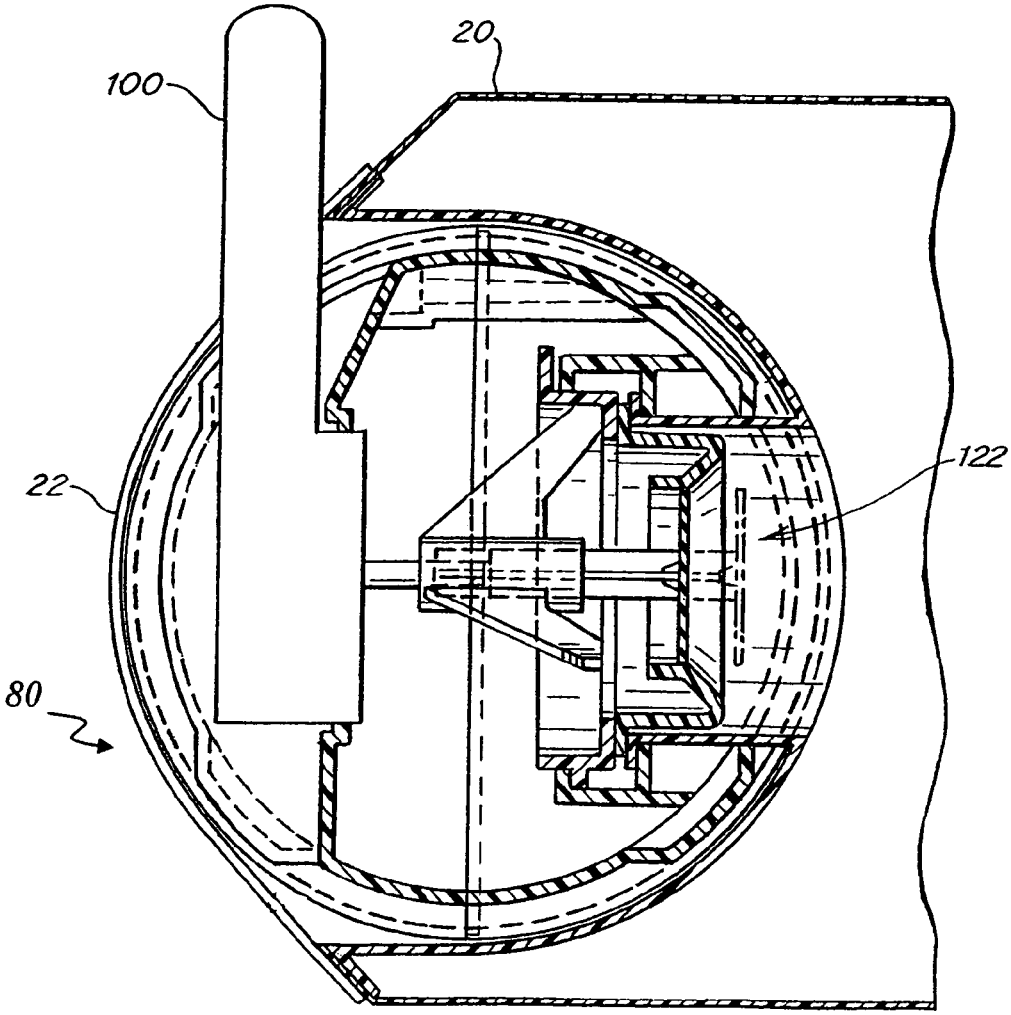
FIG. 7 is a side, cross-sectional view of another embodiment of the application.

Bladder 20 may also include structure to facilitate the connection between bladder 20 and fluid controller 80. For example, bladder 20 may have a portion constructed to facilitate connection of fluid controller 80 to bladder 20, such as a retainer 22 as illustrated in FIGS. 7 and 13. Retainer 22 may be constructed in any manner that will facilitate connection between bladder 20 and fluid controller 80, such as by mechanically supporting fluid controller 80. For example, retainer 22 may be constructed as a strap positioned across fluid controller 80.

It will now be clear that fluid controller 80 may be positioned within bladder 20 in a variety of ways. For example, fluid controller 80 may include a flange 82 that positions it at least partially within bladder 20. The size and shape of flange 82 may be selected to control the portion of pump 81 that is positioned within bladder 20. Alternatively, bladder 20 may include a recess and fluid controller 80 may be positioned within the recess and attached to bladder only at a pump outlet, or at other locations within the recess.

Fluid controller 80 may be operated by any conventional control mechanism, such as a conventional power switch. Fluid controller 80 may also include a structure for controlling fluid controller 80, such a as an adjustment device 100. Adjustment device 100 may be separate or separable from fluid controller 80 to allow fluid controller 80 to be controlled remotely. In one embodiment, adjustment device 100 is a hand-held device for controlling fluid controller 80.

Adjustment device 100 may include structure for controlling the operation of fluid controller 80. For example, adjustment device 100 may include a conventional power switch 102 that energizes and de-energizes a pump within fluid controller 80. Switch 102 may be any of the many well-known mechanisms for selectively connecting two conductors to supply electricity to a point of use. Switch 102 may allow the pump to be energized such that it inflates bladder 20. Adjustment device 100 may also include structure that directs the deflation of bladder 20. For example, a second switch may reverse the direction of the pump to deflate bladder 20. In some embodiments, fluid controller 80 may incorporate a valve which must be opened to allow deflation of bladder 20. In these embodiments, adjustment device 100 may also include structure to mechanically or electro-mechanically open a valve to allow deflation of bladder 20. For example, a switch 106 may act upon a mechanical opening mechanism or activate a solenoid 104 to open a valve, such as valve 122, and allow deflation of bladder 20. In one embodiment, the valve that is opened is a self-sealing valve, meaning that it is held closed, at least in part, by pressure within bladder 20. For example, a self sealing valve may include a diaphragm 124 that is urged against a valve seat 126 by fluid pressure from within bladder 20. Optionally, switch 106 may also energize the pump to withdraw fluid from bladder 20.

In one embodiment, adjustment device 100 is connectable to fluid controller 80. In this embodiment, adjustment device 100 may be connected to fluid controller 80 at a conveniently located position such that it is easily found, particularly when inflatable device 10 is in use. For example, where inflatable device 10 is a bed, fluid controller 80 may be located at the head of the bed such that adjustment device 100 may be connected thereto for easy access when the bed is in use. Any control elements on adjustment device 100, such as switches 102, 106 or a button 108 may be located on adjustment device 100 for easy access. For example, the control elements may be located on a top portion of adjustment device 100, as illustrated in FIG. 4. Attachment of adjustment device 100 to fluid controller 80 may also facilitate deflation of bladder 20 with adjustment device 100. For example, where a valve must be opened to deflate bladder 20, adjustment device 100 may be in mechanical communication with fluid controller 80 to disengage the valve. In one embodiment, a button 108 on adjustment device 100 may be in mechanical communication with fluid controller 80 to open a valve.

The connection between adjustment device 100 and fluid controller 80 may be secure. For example, in one embodiment, adjustment device 100 reversibly locks to fluid controller 80. Where adjustment device 100 locks to fluid controller 80, adjustment device 100 and fluid controller 80 may include mating locking mechanisms 110, 112. Locking mechanisms 110 and 112 may be constructed in any manner and using any material(s) that allow locking mechanisms 110, 112 to reversibly lock together. By "lock" it is meant that two mechanisms fit together in such a way that a force must be overcome to separate them. In one embodiment, one locking mechanism 110 includes one or more spring latches 114 that mate with impressions 116 in other locking mechanism 112. Either locking mechanism 110, 112 may be located on either of adjustment device 100 or fluid controller 80.

Having thus described certain embodiments of the inflatable device of the application, various alterations, modifications and improvements will be apparent to those of ordinary skill in the art. Such alterations, variations and improvements are intended to be within the spirit and scope of the application. Accordingly, the foregoing description is by way of example and is not intended to be limiting. The application is limited only as defined in the following claims and the equivalents thereto.

What is claimed is:

1. An inflatable device, comprising:

a substantially fluid impermeable bladder; and a fluid controller comprising an electrically powered pump, the pump being disposed at least partially within a profile of the bladder, and the fluid controller being coupled to the inflatable bladder in a position, and in the position the fluid controller being adapted to permit air to exit the bladder through the fluid controller and to be provided to the bladder through the fluid controller; and wherein the fluid controller is permanently coupled to the bladder.

2. The inflatable device of claim 1, wherein the fluid controller is constructed and arranged such that a majority of the fluid controller is positioned within the profile of the bladder.

3. The inflatable device of claim 2, wherein the fluid controller is constructed and arranged such that substantially all of the fluid controller is positioned within the profile of the bladder.

4. The inflatable device of claim 1, wherein the fluid controller comprises a housing.

5. The inflatable device of claim 4, wherein the housing comprises a flange impermeably connected to the bladder.

6. The inflatable device of claim 1, wherein the fluid controller comprises a flange impermeably connected to the bladder.

7. The inflatable device of claim 6, wherein the flange comprises a fluid impermeable wall that connects to a housing of the inflatable device.

8. The inflatable device of claim 7, wherein the flange is in contact with the housing at an outlet of the housing.

9. The inflatable device of claim 6, wherein a remainder of the fluid controller is constructed and arranged to be removable from the flange.

10. The inflatable device of claim 1, wherein the fluid controller comprises a first locking mechanism and an adjustment device including a second locking mechanism sized and adapted to mate with the first locking mechanism.

11. The inflatable device of claim 10, wherein the adjustment device further comprises:

a first switch electrically connected to the pump and a power source such that the first switch may selectively energize the pump; and a second switch mechanically connected to a valve of the fluid controller such that it may selectively open the valve;

wherein the first switch and second switch are in fixed proximity to one another.

12. The inflatable device of claim 11, wherein the adjustment device further comprises a top portion and the first switch and the second switch are positioned on the top portion.

13. The inflatable device of claim 1, further comprising an adjustment device, including:

a first switch electrically connected to the pump and a power source such that the first switch may selectively energize the pump; and a second switch electrically connected to a power source and electro-mechanically connected to a valve of the fluid controller such that it may selectively open the valve.

14. The inflatable device of claim 13, wherein the electro-mechanical connection comprises a solenoid.

15. The inflatable device of claim 1, wherein the fluid controller comprises a valve and a member connected to the valve that moves the valve between an open and a closed position.

16. The inflatable device of claim 15, wherein the member is adapted to be actuated by a switch on an adjustment device.

17. The inflatable device of claim 6, wherein the flange comprises a recess.

18. The inflatable device of claim 1, wherein a recess is formed by the fluid controller.

19. The inflatable device of claim 1, wherein the pump is at least partially positioned within a recess in the wall of the bladder.

20. The inflatable device of claim 1, wherein the pump is entirely external to the bladder.

21. The inflatable device of claim 1, wherein the pump is externally accessible.

22. The inflatable device of claim 1, further comprising a flange impermeably connected to the bladder, the flange forming a recess, wherein the pump is at least partially positioned within the profile of the bladder.

23. The inflatable device of claim 1, wherein the pump is at least partially external to the bladder.

24. The inflatable device of claim 1, wherein the bladder is shaped and sized so as to form a mattress.

25. The inflatable device of claim 1, wherein the fluid controller comprises a valve through which the air exits the bladder.

26. An inflatable system, comprising:

a substantially fluid impermeable bladder; and a fluid controller comprising:

a pump in fluid communication with the bladder through a valve and comprising a first locking mechanism; and an adjustment device including a first switch mechanically connected to the valve and adapted to mechanically actuate the valve, and a second locking mechanism sized and adapted to mate with the first locking mechanism; and wherein the pump is an electrically powered pump and wherein substantially all of the fluid controller is positioned within the profile of the bladder.

27. The inflatable system of claim 26, wherein the adjustment device further comprises:

a top portion;

a second switch having a first position and a second position, positioned on the top portion and electrically connected to the pump and a power source; and wherein the first switch is positioned on the top portion.

28. The inflatable system of claim 26 wherein the bladder includes a recess sized and configured to accommodate at least a portion of the fluid controller.

29. The inflatable system of claim 26, wherein the fluid controller includes a housing and the housing includes a flange that connects to the bladder.

30. The inflatable system of claim 26, wherein the bladder is shaped and sized so as to form a mattress.

31. An inflatable device, comprising:

a substantially fluid impermeable bladder;

a fluid controller comprising:

an electrically powered pump, and a self-sealing valve; and an adjustment device, comprising:

a first switch electrically connected to the pump and an at least one power source such that the first switch may selectively energize the pump, and a second switch electrically connected to the at least one power source and electro-mechanically connected to the self-sealing valve of the fluid controller, such that it may selectively open the self-sealing valve.

32. The inflatable device of claim 31, wherein the electro-mechanical connection comprises a solenoid.

33. The inflatable device of claim 31, wherein the bladder is shaped and sized so as to form a mattress.

34. An inflatable device, comprising:

an inflatable bladder; and a fluid controller including an electrically powered pump, the fluid controller being at least partially positioned within a profile of the bladder such that the exterior profile of the fluid controller and inflatable bladder in combination is essentially the same as the exterior profile of the inflatable bladder, at least a portion of the fluid controller that is positioned within the profile of the bladder being accessible from the exterior of the bladder, and the fluid controller being adapted to permit exhaustion of air from the bladder through the fluid controller; and wherein the fluid controller is permanently connected to the bladder.

35. An inflatable device, comprising:

an inflatable bladder; and a fluid controller including an electrically powered pump, the fluid controller being at least partially positioned within a profile of the bladder such that the exterior profile of the fluid controller and inflatable bladder in combination is essentially the same as the exterior profile of the inflatable bladder, at least a portion of the fluid controller that is positioned within the profile of the bladder being accessible from the exterior of the bladder, and the fluid controller being adapted to permit exhaustion of air from the bladder through the fluid controller; and wherein the fluid controller comprises:

a valve, and a user interface mechanically coupled to the valve, the user interface being adapted to permit a user to mechanically manipulate the valve.

36. An inflatable device, comprising:

an inflatable bladder; and a fluid controller including an electrically powered pump, the fluid controller being at least partially positioned within a profile of the bladder such that the exterior profile of the fluid controller and inflatable bladder in combination is essentially the same as the exterior profile of the inflatable bladder, at least a portion of the fluid controller that is positioned within the profile of the bladder being accessible from the exterior of the bladder, and the fluid controller being adapted to permit exhaustion of air from the bladder through the fluid controller; and wherein the pump is at least partially accessible from the exterior of the bladder.

37. An inflatable device, comprising:

an inflatable bladder; and a fluid controller including an electrically powered pump, the fluid controller being at least partially positioned within a profile of the bladder such that the exterior profile of the fluid controller and inflatable bladder in combination is essentially the same as the exterior profile of the inflatable bladder, at least a portion of the fluid controller that is positioned within the profile of the bladder being accessible from the exterior of the bladder, and the fluid controller being adapted to permit exhaustion of air from the bladder through the fluid controller; and wherein the pump is at least partially accessible from the exterior of the bladder.

38. An inflatable device, comprising:

an inflatable bladder; and a fluid controller including an electrically powered pump, the fluid controller being at least partially positioned within a profile of the bladder such that the exterior profile of the fluid controller and inflatable bladder in combination is essentially the same as the exterior profile of the inflatable bladder, at least a portion of the fluid controller that is positioned within the profile of the bladder being accessible from the exterior of the bladder, and the fluid controller being adapted to permit exhaustion of air from the bladder through the fluid controller; and wherein the bladder forms a mattress.

39. An inflatable device, comprising:

an inflatable bladder; and a fluid controller including an electrically powered pump, the fluid controller being at least partially positioned within a profile of the bladder such that the exterior profile of the fluid controller and inflatable bladder in combination is essentially the same as the exterior profile of the inflatable bladder, at least a portion of the fluid controller that is positioned within the profile of the bladder being accessible from the exterior of the bladder, and the fluid controller being adapted to permit exhaustion of air from the bladder through the fluid controller; and wherein the fluid controller comprises a valve through which the air exits the bladder.

40. An inflatable device, comprising:

a substantially fluid-impermeable bladder; and a fluid controller comprising an electrically powered pump, the fluid controller being permanently connected to the bladder, and the fluid controller being at least partially positioned within a profile of the bladder such that the external profile of the fluid controller and bladder in combination is essentially the same as the exterior profile of the bladder alone, at least a portion of the fluid controller being accessible from the exterior of the bladder, and the fluid controller being adapted to permit exhaustion of air from the bladder through the fluid controller; and wherein the fluid controller comprises a valve through which the air exits the bladder.

* * * * *